US007018959B2

(12) United States Patent
McCullough et al.

(10) Patent No.: US 7,018,959 B2
(45) Date of Patent: Mar. 28, 2006

(54) WATER-BASED METAL WORKING FLUID

(75) Inventors: Anthony A. McCullough, Bargersville, IN (US); John M. Noble, Carmel, IN (US); Phillip B. Simon, Ann Arbor, MI (US); Ross Darren Smith, Greenwood, IN (US); Scott P. Riggle, Indianapolis, IN (US); Douglas E. Doles, Greensburg, IN (US)

(73) Assignees: Miller Environmental, Shelbyville, IN (US); Miller Oil of Indiana, Inc., Indianapolis, IN (US); Masco Corporation, Taylor, MI (US)

( * ) Notice: Subject to any disclaimer, the term of this patent is extended or adjusted under 35 U.S.C. 154(b) by 79 days.

(21) Appl. No.: 10/696,700

(22) Filed: Oct. 29, 2003

(65) Prior Publication Data

US 2005/0096235 A1 May 5, 2005

(51) Int. Cl.
*C10M 141/06* (2006.01)
*B21B 45/02* (2006.01)

(52) U.S. Cl. ..... 508/250; 508/280; 508/562; 508/579; 72/42

(58) Field of Classification Search ..... 508/579, 508/562, 250
See application file for complete search history.

(56) References Cited

U.S. PATENT DOCUMENTS

| | | | | | |
|---|---|---|---|---|---|
| 2,999,064 | A | | 9/1961 | Sluhan | 252/34.7 |
| 3,618,707 | A | | 11/1971 | Sluhan | 184/1 E |
| 3,719,598 | A | | 3/1973 | King | 252/33.4 |
| 3,750,847 | A | | 8/1973 | Sluhan | 184/1 E |
| 3,948,784 | A | | 4/1976 | Krillic et al. | 252/26 |
| 4,033,886 | A | * | 7/1977 | Felton, Jr. | 508/189 |
| 4,043,925 | A | * | 8/1977 | Felton, Jr. | 508/173 |
| 4,107,060 | A | * | 8/1978 | Schick et al. | 508/280 |
| 4,111,820 | A | * | 9/1978 | Conti | 508/154 |
| 4,139,464 | A | | 2/1979 | Coward | 210/74 |
| 4,146,488 | A | | 3/1979 | Martin | 252/34.7 |
| 4,212,750 | A | | 7/1980 | Gorman | 252/32.5 |
| 4,452,711 | A | * | 6/1984 | Laemmle | 508/495 |
| 4,452,712 | A | | 6/1984 | Laemmle | 252/49.3 |
| 4,491,526 | A | * | 1/1985 | Deck | 508/431 |
| 4,492,636 | A | | 1/1985 | Burke | 210/706 |
| 4,636,321 | A | | 1/1987 | Kipp et al. | 252/49.3 |
| 4,652,372 | A | | 3/1987 | Threadgill | 210/242.3 |
| 4,654,155 | A | * | 3/1987 | Kipp et al. | 508/250 |
| 4,708,539 | A | | 11/1987 | Threadgill | 408/61 |
| 4,781,848 | A | * | 11/1988 | Biresaw et al. | 508/389 |
| 4,828,736 | A | | 5/1989 | Sandberg et al. | 252/49.3 |
| 4,925,582 | A | * | 5/1990 | Bennett | 508/248 |
| 5,512,191 | A | * | 4/1996 | Krueger | 508/250 |
| 5,795,400 | A | | 8/1998 | Berger et al. | 134/10 |
| 5,801,128 | A | | 9/1998 | Overstreet et al. | 508/159 |
| 5,983,910 | A | | 11/1999 | Berger et al. | 134/104.4 |
| 6,204,227 | B1 | * | 3/2001 | Rao et al. | 508/433 |
| 6,343,610 | B1 | | 2/2002 | Berger et al. | 134/63 |
| 6,435,198 | B1 | | 8/2002 | Berger et al. | 134/63 |
| 6,460,549 | B1 | | 10/2002 | Berger et al. | 134/60 |

OTHER PUBLICATIONS

Brochure: "Closed Loop Aqueous Cleaning at Delta Faucet Company"(undated).

* cited by examiner

*Primary Examiner*—Ellen M. McAvoy
(74) *Attorney, Agent, or Firm*—Gifford, Krass, Groh, Sprinkle, Anderson & Citkowski, P.C.

(57) ABSTRACT

A water-based, recyclable metalworking fluid comprises a polyalkylene glycol, an alkanolamine, a polyglycol surfactant, a polyol surfactant, a biocide and a corrosion inhibitor. The biocide may comprise a mixture of biocidal compounds effective against bacterial and fungal organisms. The material may also include an isoalkoxy amine oxide and a glycol ether. The composition may also include ancillary ingredients such as viscosity controlling agents, defoamers, coloring agents and the like. It is a notable feature of the composition of the present invention that it is free of hazardous materials and fatty acids. Also disclosed is a method for using the composition in a metal-shaping operation.

27 Claims, No Drawings

WATER-BASED METAL WORKING FLUID

FIELD OF THE INVENTION

This invention relates generally to metalworking fluids. More specifically, the invention relates to water-based recyclable metalworking fluids which are free of hazardous materials and which are compatible with a wide range of metal alloys.

BACKGROUND OF THE INVENTION

Metalworking fluids are employed in metalworking operations such as cutting, forming, stamping and rolling to provide cooling and lubrication to both the workpiece and the metalworking apparatus. The metalworking fluids also function to flush away oil and debris from the worksite, and they provide corrosion protection to both the workpiece and the metalworking apparatus. Initially, metalworking fluids comprised oil-based materials or emulsions of water and oil. However, the industry has increasingly sought to replace oil-based products with water-based materials. Therefore, the industry is turning toward the use of water-based metalworking fluids.

In addition to providing a cooling function, water-based metalworking fluids must provide good lubricity to the workpiece and metalworking apparatus, and be capable of sequestering and removing debris and contaminants, including oils, from the worksite. In addition, water-based metalworking fluids should provide good corrosion protection to both equipment and workpieces. Toward that end, the industry has developed various water-based metalworking fluid compositions; however, a number of problems have arisen in connection with the use of such compositions.

Many metal alloys, particularly brass and steel alloys, include lead therein, and it has been found that this lead can react with fatty acids in a metalworking fluid to produce a water-insoluble metal soap deposit which accumulates on the metalworking apparatus. The soap scum attracts and binds any oils which may be present thereby rendering the scum very sticky. The scum is very difficult to remove from parts and machinery, and can cause binding of the metalworking machinery or otherwise interfere with the metalworking process. Therefore, there is a need for a metalworking fluid which is free of fatty acids. It has also been found that various water-based metalworking fluids include ingredients which are corrosive or otherwise reactive with copper, lead, zinc and aluminum; therefore, there is a further need for a metalworking fluid which is non-corrosive to a wide variety of metals.

Biocontamination is a significant problem in metalworking fluids. Such infection can contaminate both the metalworking fluid and the metalworking apparatus, and is a result of the growth of bacteria and/or fungal organisms in the fluid. The problem is particularly severe in water-based fluids, and there is a need for a water-based metalworking fluid which is resistant to the growth of a broad spectrum of biological species therein. In order to address the various problems discussed hereinabove, prior art metalworking fluid compositions often include phenols, cresols, halogenated materials and the like in their formulations. Many of these materials are classified as hazardous materials, and their use is restricted or severely limited by law. Therefore, it is further desirable to have a metalworking fluid which does not include any hazardous materials.

As will be described hereinbelow, the present invention is directed to a water-based metalworking fluid which provides very good lubricity and cooling to equipment and workpieces. The metalworking fluid of the present invention is compatible with, and non-corrosive toward, a wide variety of metal alloys. It is free of fatty acids and hazardous materials. The metalworking fluid of the present invention is capable of removing oils, dirt and debris from workpieces and equipment. It is resistant to biological contamination, stable and recyclable.

BRIEF DESCRIPTION OF THE INVENTION

There is disclosed herein a water-based, recyclable metalworking fluid. The fluid comprises an aqueous solution of a polyalkylene glycol, an alkanolamine, a polyglycol surfactant, a polyol surfactant, a biocide package and a corrosion inhibitor. In specific embodiments, the alkanolamine may comprise one or more of triethanolamine, diethanolamine, monoisopropanolamine, diisopropanolamine, triisopropanolamine and the like. The biocide package may comprise a mixture of biocidal materials, which mixture is effective in controlling both fungal and bacterial contamination.

In specific embodiments, the metalworking fluid may further include an isoalkyloxy amine oxide and/or a benzotriazole salt. The compositions of the present invention are capable of being formulated to be free of phenolic compounds and/or fatty acids. Also disclosed are methods for using the fluids in metalworking processes, whereas spent fluid is recycled and reused.

DETAILED DESCRIPTION OF THE PREFERRED EMBODIMENTS

The water-based metalworking fluid of the present invention is comprised of a mixture of a polyalkylene glycol, which functions as a lubricant together with an alkanolamine, a first surfactant which is a polyglycol, and a second surfactant which is a polyol. The composition includes a biocide package which may comprise a single biocidal material or a combination of biocides. The composition also includes a corrosion inhibitor package which likewise may comprise a single corrosion inhibitor or a mixture of corrosion inhibitors. The foregoing ingredients are mixed in water. The composition may also be provided as a concentrate which is subsequently diluted for use. Materials of this type have been found to provide very good lubricity and cooling in metalworking processes. In addition, they function very well to sequester and remove contaminants including oils from metalworking apparatus and workpieces. The metalworking fluids of the present invention are free of fatty acids which can form deposits. They are also free of hazardous material such as phenols, cresols and the like. The compositions are compatible with a wide variety of metals including ferrous and nonferrous metals, and it is a notable feature of the present invention that they are not corrosive toward copper, zinc or lead.

In specific embodiments, the metalworking fluid comprises, on a weight basis, 12–14% of the polyalkylene glycol; 1–15% of the alkanolamine; 5–7% of the polyglycol surfactant; 0.5–1.0% of the polyol surfactant; 10–30% of the corrosion inhibitor; and 0.5–1.0% of the biocide, with the remainder being water. In certain embodiments of the foregoing composition, the alkanolamine comprises 13–15% of the composition, and in others, the corrosion inhibitor comprises 8–10% of the composition. It should be noted that throughout this specification, all percentages are given on a weight basis, unless otherwise stated.

The polyalkylene glycol functions as the primary lubricating agent in the compositions. It has been found that such materials are water-soluble yet highly lubricious. In addition, they are stable under high-temperature and high-pressure conditions which are often encountered in metalworking processes. The polyalkylene glycol materials are not degraded by contaminant oils and the like which may become mixed with the metalworking fluid, and compositions including polyalkylene glycol lubricants can be readily recycled. The most preferred polyalkylene glycols for use in the present invention are the water-soluble polyalkylene glycols. One such material comprises a polyalkylene glycol sold by the Dow Chemical Corporation under the designation "Ucon EPML-483." Other similar materials include ADDCO MLB 10X sold by the Lubrizol Corporation and Actralube BN 6000 sold by Georgia Pacific. Other similar materials are commercially available and will be readily apparent to those of skill in the art. Typically, materials of this type are supplied as aqueous solutions.

The metalworking fluids of the present invention also include an alkanolamine. There are a number of alkanolamines which may be used either singly or in combination in the present invention. Preferred alkanolamines are generally $C_1$–$C_4$ alkanolamines. Primary, secondary and tertiary alkanolamines may all be employed in the practice of the present invention. One specific preferred alkanolamine comprises triethanolamine (TEA). Mono- and di-ethanolamine may also be employed. Other alkanolamines include mono-, di- and tri-isopropanolamine. The alkanolamines may be used either singly or in combination, and generally comprise 1–15%, and in certain embodiments 13–15% of the composition.

The composition of the present invention preferably includes two surfactants, a first being a polyglycol surfactant and a second being a polyol surfactant. It has been found that this combination of surfactants provides superior sequestering performance and facilitates the removal of oils and other such hydrophobic materials from the workpiece and machinery. One polyglycol surfactant having utility in the present invention comprises a block copolymer of polyoxypropylene and polyoxyethylene. Surfactants of this type are commercially available from a number of sources, and one material having particular utility in the present invention comprises the product sold under the designation Pluronic 17R2. This material is available from The BASF Corporation. Other such surfactants which may be used in this invention include P-41-300 sold by the Hoescht Celanese Corporation, and Triton EF-14 sold by Rohm and Haas. Yet other materials will be known to those of skill in the art.

The polyol surfactant, in one embodiment, comprises a material sold under the designation Superwet 9.5 by the Superior Chemical Corporation of Indianapolis, Ind. This particular material comprises poly(oxy-1,2-ethanediyl), alpha-(4 nonylphenyl)-omega-hydroxy, branched. Other polyol and polyglycol surfactants may be likewise employed in the practice of the present invention. Some such materials include Triton N-101 sold by Rohm and Haas, and Tomadol 9E0 sold by Tomal Products, Inc. of Milton, Wis. While there is a wide range of compositions which may be implemented in accord with the present invention, in one preferred embodiment, the polyglycol surfactant is present in the range of 5–7% and the polyol surfactant in the range of 0.5–1.0%.

The material of the present invention includes a biocide which, in one preferred embodiment, is a mixture of materials having a biocidal effect against both bacteria and fungi. One preferred mixture comprises a first component which is a morpholine compound. One preferred morpholine biocidal compound comprises 4-(2-nitrobutyl) morpholine. Other morpholine materials include 4,4'-(2-ethyl-2-nitrotrimethylene)dimorpholine and methylene dimorpholine. Biocidal morpholine mixtures are available from the Angus Chemical Company of Buffalo Grove, Ill. under the designation Bioban P-1487 and Bioban CS-1135. The material sold by Rohm and Haas under the designation Kaython EDC 1.5 may also be used in this regard. Another preferred biocidal material for incorporation into the metalworking fluid of the present invention comprises a product sold under the designation Busan 77 by Buckman Laboratories, Inc. of Memphis, Tenn. This material comprises poly(oxy-1,2-ethanediyl (dimethylimino)-1,2-ethanediyl (dimethylimino)-1,2-ethanediyl dichloride). Equivalent compositions are sold under the designation Bioban TS by Angus Chemical Company, and the aforementioned Kaython EDC 1.5. In specific embodiments of the present invention, a biocidal mixture of 0.35–0.5% of the Bioban P-1487 material and 0.5–1.0% of the Busan 77 material is employed. Other compositional ranges of these materials, as well as other combinations of materials, are also useful in the practice of the present invention.

The compositions of the present invention preferably will also include a corrosion inhibitor. The specific corrosion inhibitor employed will depend, to some degree, upon the nature of the metals with which the material is being employed. One class of compounds having utility as corrosion inhibitors comprise thiazoles, and one specific thiazole material is sodium 2-mercaptobenzothiazole. Such material is available from the Lubrizol Corporation of Wickliffe, Ohio in a formulation sold under the designation Aqualox 236. Other corrosion inhibitors include the materials sold by Lubrizol Corporation under the designation Alox. Typically, the corrosion inhibitor will be present in an amount of about 10–30%, and in specific embodiments in a range of 8–10%.

In addition to the foregoing, the metalworking fluids of the present invention may include other active components. One material often employed in the compositions of the present invention comprises diethylene glycol monobutyl ether. This material is often referred to the in art as glycol ether DB, and in the compositions of the present invention is typically present in an amount of approximately 0.5–2%. Other ingredients in the composition of the present invention include isoalkyloxy amine oxide. This material may be present in an amount of approximately 10–12%. Additional amounts of benzotriazole salts may also be added to the compositions.

The metalworking fluids of the present invention may also include ancillary ingredients such as coloring agents, fragrances, viscosity or rheology control agents, defoamers, scents and the like.

In view of the teaching presented herein, a number of compositions of the present invention may be readily implemented by those of skill in the art. One particular composition of the present invention comprises, on a weight basis:

| | |
|---|---|
| Monoisopropanolamine | 1–2% |
| Diisopropanolamine | 6–6.5% |
| Triisopropanolamine | 6.6.5% |
| Isoalkyloxy amine oxide | 10.12% |
| 4(2-nitrobutyl)morpholine 76–85%; 4,4' (2-ethyl-2-nitrotrimethylene)dimorpholine 2–7%; methylene dimorpholine 3.9–6.5%; morpholine 3–6%; 1-nitropropane .3–5.3% (Bioban P-1487) | .35–.5% |
| Sodium 2-mercaptobenzothiazole rust inhibitor | 8–10% |

-continued

| | |
|---|---|
| (Aqualox 236) | |
| Polyoxypropylene block polymer | 5–7% |
| Benzotriazole sodium salt | 1.5–2% |
| Poly(oxy-1,2-ethanediyl(dimethylimino)-1,2-ethanediyl(dimethylimino)-1,2-ethanediyl dichloride) .5–1.0%; polyalkylene glycol (Ucon EPML-483) 12–14%; poly(oxy-1-2-ethanediyl), alpha-(4-nonylphenyl)-omega-hydroxy, branched .5–1.0% | |

It has been found that the foregoing composition functions very well as a metalworking fluid for cutting or otherwise shaping a wide variety of materials including leaded brass. The composition provides a high degree of lubricity, and is compatible with high volume, high speed metalworking systems. The fluid is stable against biological contamination, and does not form metallic soap deposits. It readily cleans and sequesters oils and is non-corrosive to brass. The service life of the material is long, and it may be readily recycled. In that regard, spend fluid may be collected and filtered to remove impurities and debris. Oils and other contaminants may be removed by skimming and/or filtering, and the resultant fluid reused in the metalworking process. In some instances, the recycled fluid will have certain of its components replenished before reuse.

Yet other compositions may be implemented in accord with the teaching presented herein. Modifications of the foregoing composition may be prepared, for example, by adding 1.25–1.75% of glycol ether DB to the mixture. Relatively small amounts of an anti-foaming agent, such as a polysiloxane defoamer, may be added to the composition. Typically, defoamers are employed in approximately 0.05–0.25%. Yet other compositions may be implemented in accord with the teachings presented herein. It is to be understood that the foregoing discussion, description and examples are illustrative of particular embodiments of the invention but are not meant to be limitations upon the practice thereof. It is the following claims, including all equivalents, which define the scope of the invention.

The invention claimed is:

1. A water-based, recyclable metalworking fluid comprising:

water;

a water-soluble polyalkylene glycol lubricating agent;

an alkanolamine;

a polyglycol surfactant having a composition which differs from that of said polyalkylene glycol lubricating agent;

a polyol surfactant having a composition which differs from that of said polyalkylene glycol lubricating agent and said polyglycol surfactant;

a biocide; and a corrosion inhibitor;

said fluid being further characterized in that it is free of fatty acids.

2. The metalworking fluid of claim 1, further including an isoalkyloxy amine oxide.

3. The metalworking fluid of claim 1, further including a benzotriazole salt.

4. The metalworking fluid of claim 1, wherein said alkanolamine comprises a mixture of alkanolamines.

5. The metalworking fluid of claim 1, wherein said alkanolamine is selected from the group consisting of: triethanolamine, diethanolamine, monoisopropanolamine, diisopropanolamine, triisopropanolamine, and combinations thereof.

6. The metalworking fluid of claim 1, wherein said biocide comprises a mixture of biocidal materials, said mixture having an antibacterial and an antifungal effect.

7. The metalworking fluid of claim 6, wherein said mixture of biocidal materials includes at least one morpholine compound.

8. The metalworking fluid of claim 6, wherein said mixture of biocidal materials includes poly(oxy-1,2-ethanediyl(dimethylimino)-1,2-ethanediyl(dimethylimino)-1,2-ethanediyl dichloride).

9. The metalworking fluid of claim 1 characterized in that it is free of phenols.

10. The metalworking fluid of claim 1, wherein said polyglycol surfactant comprises a polyoxypropylene-polyoxyethylene block copolymer.

11. The metalworking fluid of claim 1 wherein the polyol surfactant comprises poly(oxy-1-2-ethanediyl),alpha-(4nonylphenyl)-omegahydroxy branched.

12. A water-based, recyclable metalworking fluid comprising, on a weight basis:

12–14% of a water-soluble polyalkylene glycol lubricating agent;

1–15% of an alkanolamine;

5–7% of a polyglycol surfactant having a composition which differs from that of said polyalkylene glycol surfactant;

0.5–1.0% of a polyol surfactant having a composition which differs from that of said polyalkylene glycol lubricating agent and said polyglycol surfactant;

10–30% of a corrosion inhibitor;

0.5–1.0% of a biocide; and the remainder, water;

said fluid being further characterized in that it is free of fatty acids.

13. The metalworking fluid of claim 12, further including, on a weight basis: 10–12% of isoalkyloxy amine oxide.

14. The metalworking fluid of claim 12, further including, on a weight basis: 1.5–2% of a benzotriazole salt.

15. The metalworking fluid of claim 12, wherein said biocide comprises a mixture of biocidal materials, said mixture having antibacterial and antifungal effects.

16. The metalworking fluid of claim 15 wherein said mixture of biocidal materials includes, on a weight basis, 0.35–0.5% of a morpholine compound.

17. The metalworking fluid of claim 15, wherein said mixture of biocidal materials includes, on a weight basis, 0.5–1.0% of poly(oxy-1,2-ethanediyl(dimethylimino)-1,2-ethanediyl(dimethylimino)-1,2-ethanediyl dichloride).

18. The metalworking fluid of claim 12, further including a material selected from the group consisting of: surfactants, antifoaming agents, coloring agents, fragrances, viscosity control agents, and combinations thereof.

19. The metalworking fluid of claim 12, wherein the alkanolamine component comprises 13–15% of the composition.

20. The metalworking fluid of claim 12, wherein the corrosion inhibitor comprises 8–10% of the composition.

21. A method for shaping a metal workpiece, said method including the step of:

contacting said workpiece with a water-based, recyclable metalworking fluid, while said workpiece is being shaped, said fluid comprising:

a water soluble polyalkylene glycol lubricating agent;

an alkanolamine;

a polyglycol surfactant having a composition which differs from that of said polyalkylene glycol lubricating agent;

a polyol surfactant having a composition which differs from that of said polyalkylene glycol lubricating agent and said polyglycol surfactant;

a biocide; and a corrosion inhibitor;

said fluid being further characterized in that it is free of fatty acids.

22. The method of claim 21, including the further steps of:

collecting spent metalworking fluid; and recycling said spent metalworking fluid.

23. The method of claim 21, wherein said workpiece comprises leaded brass, and wherein said method of shaping comprises cutting said leaded brass workpiece.

24. The method of claim 21, wherein said fluid comprises, on a weight basis:

12–14% of said polyalkylene glycol;

1–15% of said alkanolamine;

5–7% of said polyglycol surfactant;

0.5–1.0% of said polyol surfactant;

10–30% of said corrosion inhibitor;

0.5–1.0% of said biocide; and the remainder water.

25. The method of claim 24, wherein said metalworking fluid further includes, on a weight basis, 10–12% of isoalkyloxy amine oxide.

26. The method of claim 24, wherein said metalworking fluid further includes, on a weight basis, 1.5–2% of a benzotriazole salt.

27. A water-based, recyclable metalworking fluid comprising:

water;

a water-soluble polyalkylene glycol lubricating agent;

an alkanolamine;

a polyglycol surfactant having a composition which differs from that of said polyalkylene glycol lubricating agent;

a polyol surfactant having a composition which differs from that of said polyalkylene glycol lubricating agent and said polyglycol surfactant;

a biocide;

a corrosion inhibitor; and an isoalkoxy amine oxide.

* * * * *